US005356230A

United States Patent [19]

Ueda et al.

[11] Patent Number: 5,356,230

[45] Date of Patent: Oct. 18, 1994

[54] SHEET GUIDE ATTACHING MECHANISM OF A PRINTER

[75] Inventors: Hidenori Ueda; Kenichi Egawa; Yosimizu Yuasa, all of Tokyo, Japan

[73] Assignee: Oki Electric Industry Co., Ltd., Tokyo, Japan

[21] Appl. No.: 148,412

[22] Filed: Nov. 8, 1993

Related U.S. Application Data

[63] Continuation of Ser. No. 48,005, Apr. 19, 1993, abandoned.

[30] Foreign Application Priority Data

May 7, 1992 [JP] Japan ..... 4-29695[U]

[51] Int. Cl.[5] ..... B41J 11/50

[52] U.S. Cl. ..... 400/605; 400/625; 400/693; 400/647.1; 400/599.1

[58] Field of Search ..... 400/605, 599.1, 607, 400/607.2, 625, 647, 647.1, 691, 693

[56] References Cited

U.S. PATENT DOCUMENTS

| | | | |
|---|---|---|---|
| 4,488,829 | 12/1984 | Hidaka | 400/605 |
| 4,504,161 | 3/1985 | Volke et al. | 400/605 |
| 4,995,745 | 2/1991 | Yokoi et al. | 400/605 |
| 5,106,220 | 4/1992 | Ricca et al. | 400/693 |
| 5,139,354 | 8/1992 | Saeki | 400/605 |
| 5,141,346 | 8/1992 | Nakagawa | 400/605 |
| 5,158,381 | 10/1992 | Inomata et al. | 400/605 |
| 5,186,556 | 2/1993 | Koyanagi | 400/605 |
| 5,186,557 | 2/1993 | Fushimi | 400/693 |
| 5,207,521 | 5/1993 | Ricca et al. | 400/647.1 |
| 5,255,989 | 10/1993 | Berthold et al. | 400/605 |

*Primary Examiner*—Eugene H. Eickholt
*Attorney, Agent, or Firm*—Steven M. Rabin

[57] ABSTRACT

A sheet guide attaching mechanism comprises front and rear end portions of the sheet guide which respectively serve as turning fulcrums and are detachable from a printer. When printing is performed on a cut sheet, the rear end portion is detached from the printer and the sheet guide is turned about the front end portion as the fulcrum and is held by a holding portion while the sheet guide remains standing. When printing is performed on a continuous forms sheet, the front end portion is detached from the printer and the sheet guide is turned about the rear end portion as the fulcrum, to a standing position. The continuous forms sheet is set on the printer in this state.

17 Claims, 7 Drawing Sheets

SHEET GUIDE ATTACHING MECHANISM OF A PRINTER

This application is a continuation of application Ser. No. 08/048,005, filed Apr. 19, 1993, now abandoned.

BACKGROUND OF THE INVENTION

1. Field of the Invention

The present invention relates to a sheet guide to be attached to a printer, which uses a cut sheet and a continuous forms sheet as a printing medium, particularly to a sheet guide attaching mechanism.

2. Description of the Prior Art

Generally, a cut sheet and a continuous forms sheet can be mounted on a serial printer which performs printing on both the sheets. In case that printing is performed on the cut sheet, a sheet guide is required for holding a plurality of cut sheets while setting the cut sheets thereon. However, when the continuous forms sheet is set on the printer, the sheet guide becomes an obstacle. Accordingly, the sheet guide should be shunted from the travel route of the continuous forms sheet.

There are two methods of attaching the sheet guide to the printer. One method is to attach the sheet guide turnably on a printer body and to shunt the same sheet guide from the travel route of the continuous forms sheet when the latter is set on the printer. Another method is to attach the sheet guide detachably on the printer body and to detach the sheet guide from the printer when the continuous forms sheet is set on the printer. However, there are following problems. In the former method, a member for supporting the sheet guide is required in addition to the sheet guide or the sheet guide should be molded so as to be shunted from the travel route of the continuous forms sheet. In the latter method, the sheet guide should be detached before printing is performed on the continuous forms sheet and it should be attached after printing on the continuous forms is completed, which is troublesome and operability thereof is deteriorated.

SUMMARY OF THE INVENTION

It is an object of the present invention to provide a sheet guide attaching mechanism capable of using a continuous forms sheet without detaching the sheet guide from the printer and of improving the operability of the sheet guide when the continuous forms sheet is set on the printer.

It is another object of the present invention to provide a sheet guide capable of dispensing with a member for supporting the sheet guide and of being manufactured at low cost.

It is still another object of the present invention to provide a sheet guide capable of dispensing with a mold for manufacturing the sheet guide and of reducing the steps of assembling the sheet guide.

To achieve the above objects, the sheet guide attaching mechanism of a printer according to the present invention comprises a first retaining portion formed on an upper portion of the printer, a second retaining portion which is formed on the front end portion of a sheet guide and turnable and detachable relative to the first retaining portion, a holding portion for holding the sheet guide while the latter remains standing, a turnable supporting shaft which is formed on a rear end portion of the printer, a third retaining portion which is formed on the rear end portion of the sheet guide turnable and detachable relative to the turnable supporting shaft, wherein printing is performed on a cut sheet by the steps of allowing the third retaining portion to come off from the turnable supporting shaft, holding the sheet guide by the holding portion while the sheet guide remains standing, setting the cut sheet on the sheet guide so as to convey the cut sheet to a printing position and actuating a print head so as to perform printing on the cut sheet, and wherein printing is performed on a continuous forms sheet by the steps of allowing the first retaining portion to come off from the second retaining portion, turning the sheet guide about the turnable supporting shaft so as to make the sheet guide stand, setting the continuous forms sheet on the printer so as to convey the continuous forms paper to a printing position and actuating the print head so as to perform printing on the continuous forms sheet.

According to the present invention, when printing is performed on the cut sheet, the sheet guide is turned about the second retaining portion and is held by the holding portion while it remains standing. At this stage, the cut sheet is set on the sheet guide and printing is performed thereafter.

When printing is performed on the continuous forms sheet, the sheet guide is turned about the turnable supporting shaft. At this stage, the continuous forms sheet is set on the printer and the sheet guide is turned about the turnable supporting shaft in the opposite direction to thereby return it to the original position upon completion of the setting of the continuous forms sheet and printing is performed thereafter.

DESCRIPTION OF THE PREFERRED EMBODIMENT

First Embodiment (FIGS. 1 to 11)

A sheet guide attaching mechanism of a printer according to a first embodiment of the present invention will be described with reference to FIGS. 1 to 11.

Figure 1:
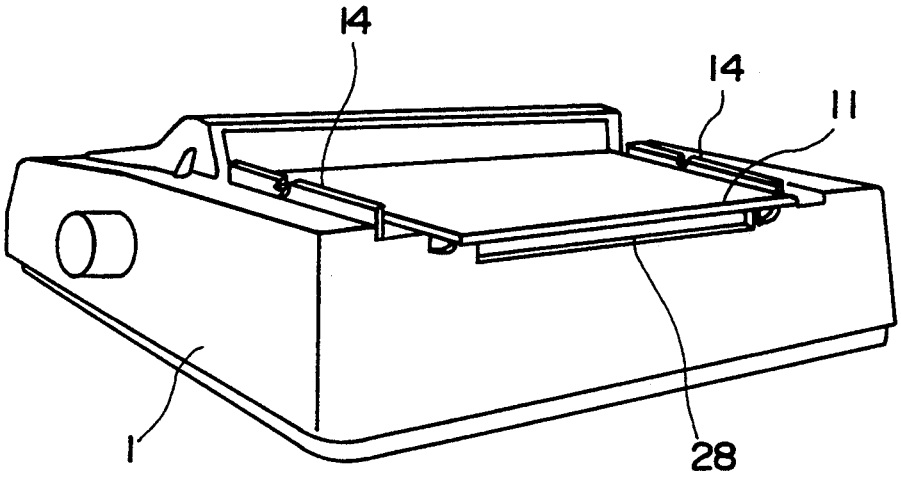
FIG. 1 is a perspective rear view of a printer equipped with a sheet guide attaching mechanism according to a first embodiment of the present invention.
Figure 2:
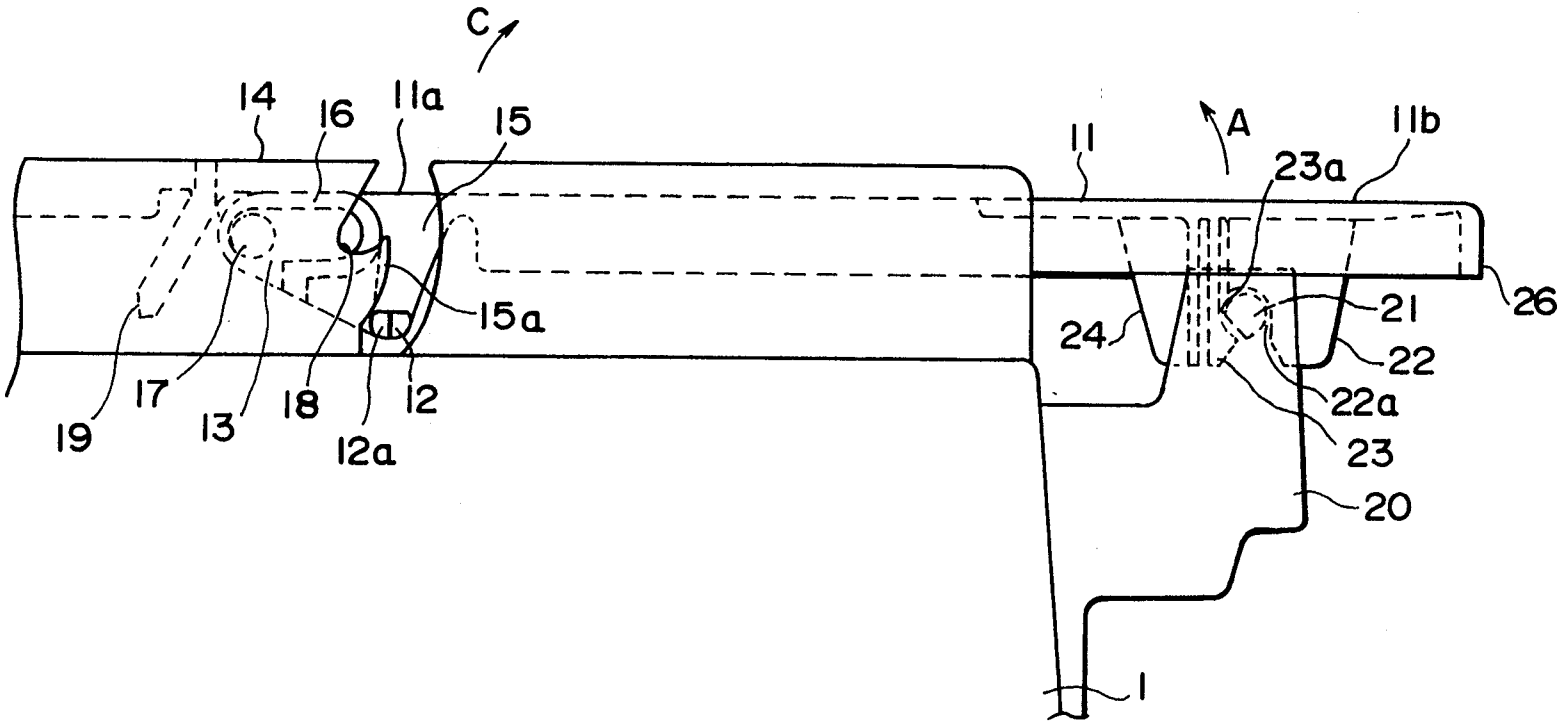
FIG. 2 is a side view showing a structure of the sheet guide attaching mechanism.

In FIGS. 1 and 2, a sheet guide 11 is attached to an upper portion of a printer body 1 and in FIG. 2, the sheet guide 11 has a front end or front end portion 11*a* at the left side thereof and a rear end or rear end portion 11*b* at the right side thereof.

Figure 3:
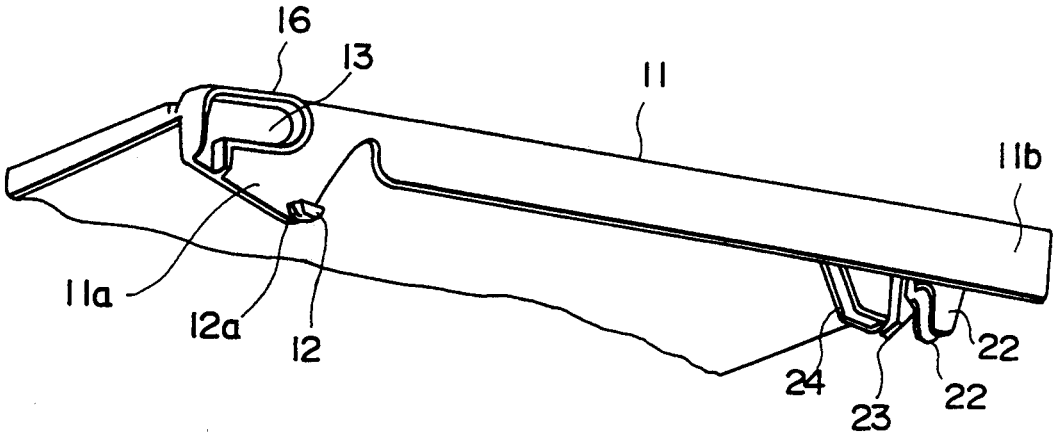
FIG. 3 is a perspective view of a sheet guide in which a part thereof is cut.
Figure 4:
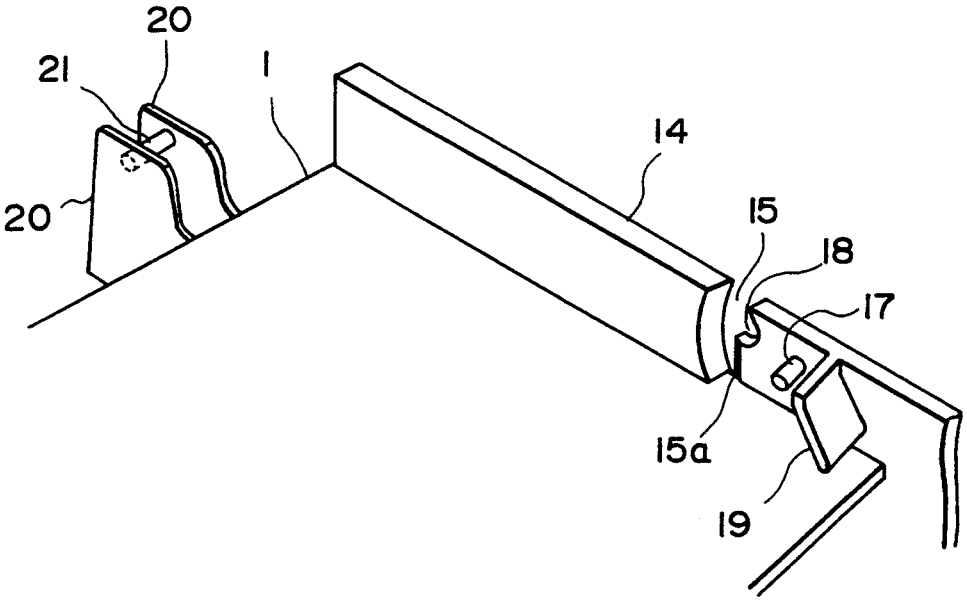
FIG. 4 is a perspective view of a main portion of the printer a part of which is cut.
Figure 5:
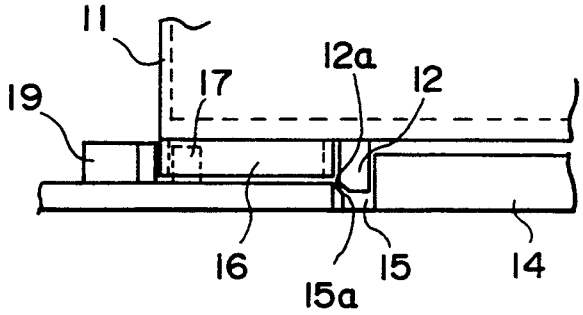
FIG. 5 is a plan view showing a front end portion of the sheet guide.

In FIGS. 2, 3 and 4, a movable supporting shaft 12 and a turnable supporting hole 13 form a retainer 50 on the side portion of the front end portion 11*a*. The movable supporting shaft 12 is gently engaged in a curved groove 15 of a retainer 52 formed in an attached bracket 14 integrated with the printer body 1, and is movable along the curved groove 15. A left side portion 12*a* of the movable supporting shaft 12 is chamferred and an inner side 15*a* of the left side wall of the curved groove 15 (at the side of the sheet guide 11) is also chamferred. When the sheet guide 11 is positioned as illustrated in FIG. 2, i.e. when it is not turned, the movable supporting shaft 12 is positioned immediately under the chamferred portion 15*a*. The turnable supporting shaft hole 13 is formed oval by a protruded wall 16 which protrudes from the side surface of the sheet guide 11. A turnable supporting shaft 17, which is formed on the attached bracket 14 and protrudes toward the sheet guide 11, is gently engaged in the turnable supporting shaft hole 13, as illustrated in FIG. 5.

A movable curved-shaped supporting shaft receiver 18 is formed in the attached bracket 14 adjacent to the curved groove 15. The movable supporting shaft 12 is positioned in the movable supporting shaft receiver 18 when the sheet guide 11 is standing. A stopper 19 is formed on the attached bracket 14 in front of the protruded wall 16 (left side in FIG. 2). The attached brackets 14 are provided outside of the sheet guide 11 and all the components as set forth above are formed on both attached brackets and both sides of the sheet guide 11.

A pair of rear brackets 20 are provided at the rear end portion of the printer body 1 and have a turnable supporting shaft 21 therebetween. A pair of retaining fibs 22, a retaining pawl 23 and a stopper rib 24 form a retainer 54 at the rear end portion 11*b* of the sheet guide 11. The retaining ribs 22 and the retaining pawl 23 have curved portions 22*a* and 23*a* which clamp the turnable supporting shaft 21 so that the rear end portion 11*b* of the sheet guide 11 is held to the printer body 1. The retaining ribs 22 prevent the retaining pawl 23 from coming out from the turnable supporting shaft 21 when the sheet guide 11 is turned clockwise about the turntable shaft 21. The retaining pawl 23 can be bent in the direction to move away from the turnable supporting shaft 21. When the retaining pawl 23 is bent in this direction, the turntable supporting shaft 21 is released from being retained by the retaining fib 22 and the retaining pawl 23.

Figure 6:
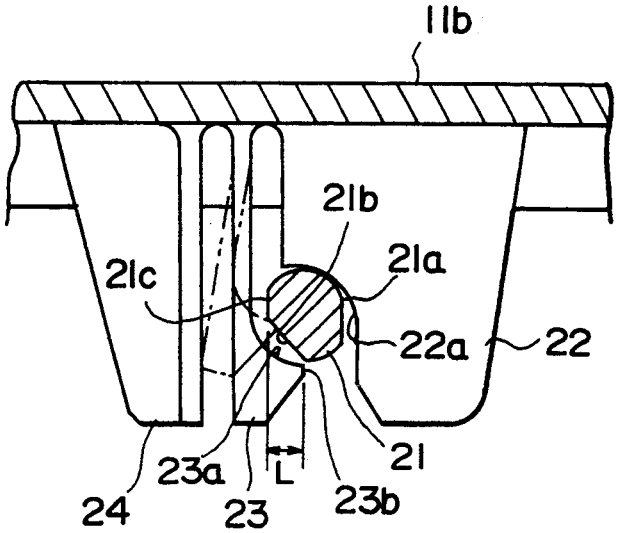
FIG. 6 is a cross-sectional side view showing a rear end portion of the sheet guide.

In FIG. 6, the turnable supporting shaft 21 is chamferred to form chamferred portions 21*a* and 21*b* and 21*c*. The chamferred portions 21*a* and 21*c* are chamferred vertically and the chamferred portion 21*b* faces the curved portion 23*a* of the retaining pawl 23. The retaining rib 22, the retaining pawl 23 and the stopper rib 24 are respectively provided on both sides of the sheet guide 11.

An operation of the sheet guide attaching mechanism will be described hereinafter.

When printing is performed neither on a cut sheet nor on a continuous forms sheet, the sheet guide 11 is prone, that is positioned horizontally on the upper portion of the printer body as illustrated in FIG. 2.

When printing is performed on the cut sheet, a sheet guide 11 should be raised from the state as illustrated in FIG. 2 to a standing position, by raising the rear end portion 11*b* thereof.

At this time, the end portion 23*b* of the retaining pawl 23 is brought into contact with the chamferred portion 21*b* of the turnable supporting shaft 21 and moves along the chamferred portion 21*b*, 50 as to be bent as illustrated in two dot chain line in FIG. 6. The amount of bending of the retaining pawl 23 corresponds to the distance L between the end portion 23*b* of the pawl 23 and a vertical line extending from the chamferred portion 21*c* at the point where the vertical line crosses a horizontal line extending from the end portion 23*b*, as illustrated in FIG. 6. The retaining pawl 23 comes off from the turnable shaft 21 by a relatively small load.

Figure 7:
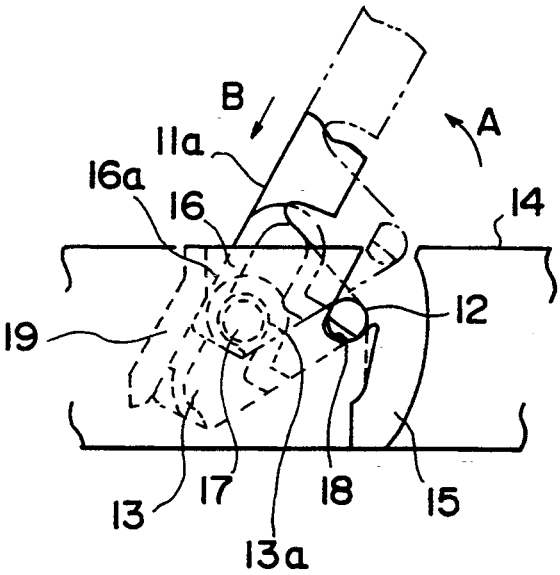
FIG. 7 is a side view for illustrating an operation of the front end portion of the sheet guide.

When the rear end portion 1 lb of the sheet guide 11 comes off from the turnable supporting shaft 21, the sheet guide 11 is turned in the direction of the arrow A about the turnable supporting shaft 17 which is positioned at the front end portion 11*a* thereof. At this time, the movable supporting shaft 12 moves upward along the curved groove 15 of the attached bracket 14. The turning of the sheet guide 11 is stopped when the outside surface 16*a* of the protruded wall 16, which is provided at the front end portion 11*a* of the sheet guide 11, is brought into contact with the stopper 19, as illustrated in two dot chain line in FIG. 7. At this time, the movable supporting shaft 12 comes off upward from the crowed groove 15. The sheet guide 11 is stopped at the position where it is turned at an angle of about 60° from the horizontal position thereof, namely, from the position before it is turned. This angle is not limited to 60° but may be one adapted for setting the cut sheet thereon. From this state, the sheet guide 11 is slid in the direction of the arrow B as illustrated in FIG. 7, and the protruded wall 16 moves along the stopper 19, whereby the movable supporting shaft 12, which comes off from the curved groove 15, engages in the movable supporting shaft receiver 18 formed on the attached bracket 14 while the turnable supporting shaft 17 formed on the attached bracket 14 engages in the crowed portion 13*a* of the turnable supporting shaft hole 13, thereby to hold the guide 11 in a standing position. This state is illustrated in a solid line of FIG. 7.

Figure 8:
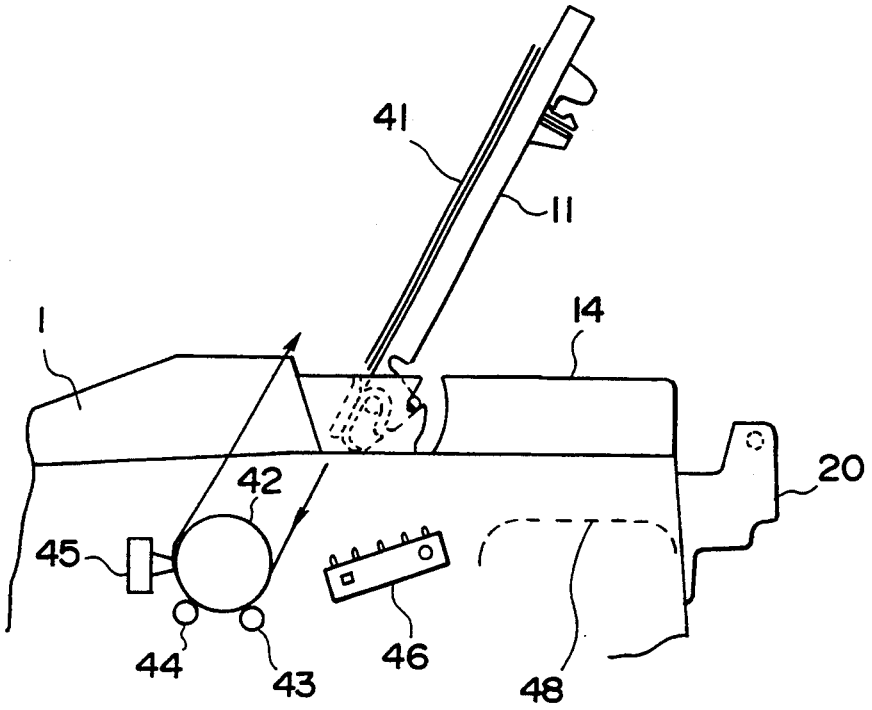
FIG. 8 is a view illustrating the state in which the sheet guide remains standing.

In FIG. 8, the sheet guide 11 remains standing. In the same figure, if a cut sheet 41 is set on the sheet guide 11, it is ready for printing. If a printing instruction is issued, the cut sheet 41 is conveyed around a platen 42 by conveying rollers 43 and 44 and printing is performed on the cut sheet 41. The printed cut sheet 41 is discharged upward from the printer body 1. Denoted at 46 is a pin tractor for conveying the continuous forms sheet.

The case where printing is performed on the continuous forms sheet will be described firstly with reference to FIG. 2 showing the state where the sheet guide 11 is positioned horizontally.

The front end portion 11*a* of the sheet guide 11 is raised in the direction of the arrow C so that the sheet guide 11 is turned about the turnable supporting shaft 21. At this time, the movable supporting shaft 12 formed on the front end portion 1 la of the sheet guide 11 approaches the left side portion of the curved groove 15 formed on the attached bracket 14 and the chamferred portion 12*a* of the movable supporting shaft 12 contacts the chamferred portion 15*a* , which is formed at the left side portion of the curved groove 15. If the front end portion 11*a* of the sheet guide 11 is further raised, the movable supporting shaft 12 comes off from the curved groove 15 and moves upward. At this time, the turnable supporting shaft 17 comes off from the turnable supporting shaft hole 13.

If the front end portion 1 la of the sheet guide 11 is raised, the sheet guide 11 is turned clockwise about the movable supporting shaft 21 so that the stopper 26 provided at the rear end 11*b* of the sheet guide 11 is brought into contact with the lower end portion 27 of the rear bracket 20. As a result, the sheet guide 11 is prevented from further being turned, namely, stopped as illustrated in FIG. 10, and the continuous forms sheet is set on the printer at this state.

Figure 10:
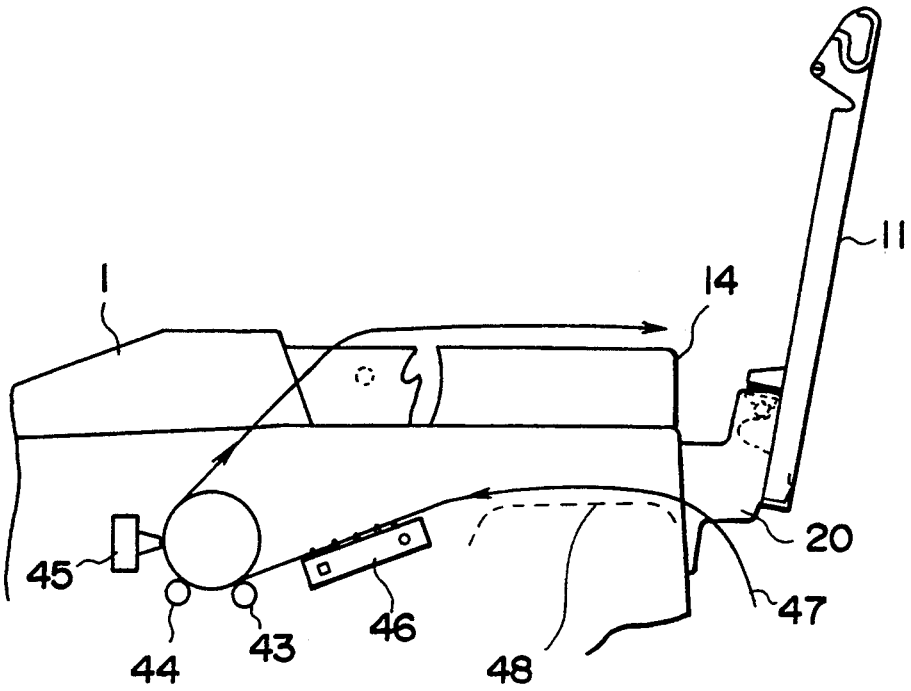
FIG. 10 is a view showing the state in which the sheet guide is turned.

In FIG. 10, the continuous forms sheet 47 is inserted into the direction of the arrow along a guide 48 provided in the printer body 1 and is set on the pin tractor 46. Upon completion of the setting of the continuous forms sheet 47, the guide sheet 11 is horizontally positioned as illustrated in FIG. 2. At this state, the continuous forms sheet is ready for printing. If the printing instruction is issued, the continuous forms sheet 47 is conveyed around the platen 42, and between the platen and printing head 45, by the conveying rollers 43 and 44, and printing is performed on the continuous forms sheet by the print head 45. The printed continuous forms sheet is passed over the sheet guide 11 toward, and then rearward of the printer body 1.

Figure 9:
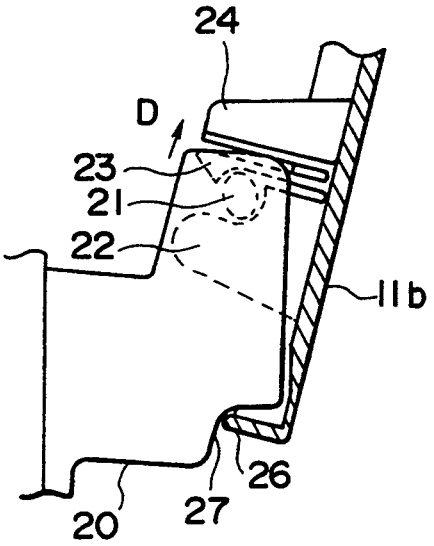
FIG. 9 is a view illustrating an operation of the rear end portion of the sheet guide.
Figure 11:
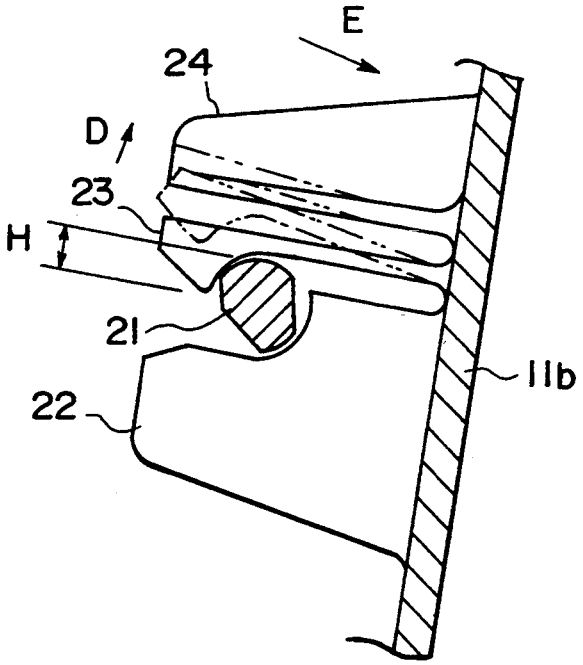
FIG. 11 is a cross-sectional enlarged side view of the rear end portion of the sheet guide.

If any force is applied to the sheet guide 11 so as to open the guide sheet further from the standing position illustrated in FIG. 10, the retaining pawl 23 of the rear end portion 11*b* of the sheet guide 11 is bent upward (in the direction of the arrow D) from the state as illustrated in FIG. 9 and the rear end portion 11*b* comes off from the turnable supporting shaft 21 before the retaining pawl 23 or the turnable supporting shaft 21 is broken. However, if the force is applied to the rear end portion 11*b* in the direction of the arrow E of FIG. 11, the retaining pawl 23 does not come off from the turnable supporting shaft 21 if it is not bent in the direction of D by the distance H as illustrated in FIG. 11. If the retaining pawl 23 is bent by the distance H, a fall prevention rib 24, as illustrated in FIG. 11, should be bent at the same time. Accordingly, a large load should be applied to the rear end portion 11*b* to bend the retaining pawl 23. Accordingly, the sheet guide 11 does not come off normally from the turnable supporting shaft 21 in a series of operations to open the sheet guide rearward.

Upon completion of the setting of the continuous forms sheet, the sheet guide 11 is turned in the direction opposite to the direction to which it is opened about the turnable supporting shaft 21 and the movable supporting shaft 12 of the front end portion 11*a* enters the curved groove 15 while at the same time the turnable supporting shaft 17 provided on the attached bracket 14 enters the turnable supporting shaft hole 13 whereby the sheet guide 11 is closed. In this state of the printer, printing is performed on the continuous forms sheet.

As described above, since the turning fulcrum is also provided at the rear end portion of the sheet guide, it is not necessary to detach the sheet guide from the printer body 1 even if printing is performed on the continuous forms sheet, which results in improving the operability of the sheet guide when the continuous forms sheet is set, and results in reducing the number of components and cost of the sheet guide attaching mechanism.

Figure 12:
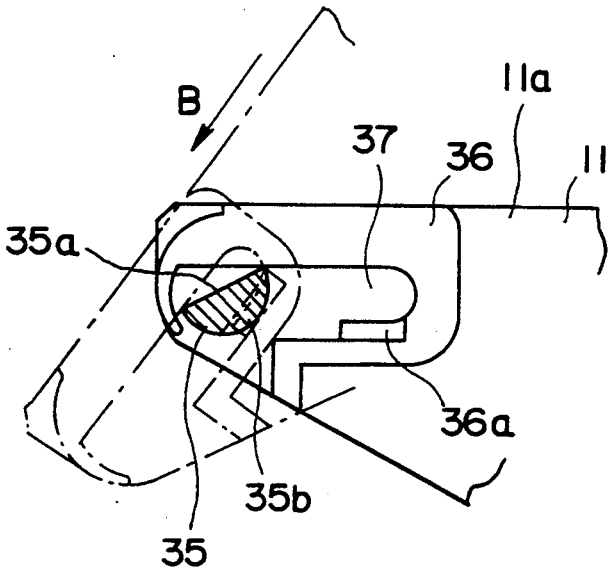
FIG. 12 is a cross-sectional side view of the front end portion of a sheet guide according to a second embodiment.

Second Embodiment (FIG. 12)

A sheet guide attaching mechanism of a printer according to a second embodiment of the present invention will be described with reference to FIG. 12.

The sheet guide attaching mechanism of the second embodiment has the same structure as that of the first embodiment, except for the stopper and the movable supporting shaft. Accordingly, the components which are the same as those in the first embodiment have the same numerals and the explanation thereof is omitted.

Although the stopper 19 is provided in the first embodiment for holding the sheet guide 11 while the latter remains standing when a cut sheet is used, the stopper 19 may be replaced by a mechanism as illustrated in FIG. 12 if the stopper 19 can not be physically provided on the attached bracket 14.

In the same figure, a turnable supporting shaft 35 having a substantially semi-circular shape in cross section is provided on the printer body 1. The turnable supporting shaft 35 has a fiat portion 35*a* and a chamferred portion 35*b* at the rear side of the fiat portion 35*a* facing the sheet guide 11. The fiat portion 35*a* is positioned at an angle of 60° relative to the vertical direction, as illustrated in FIG. 12.

A protruded wall 36, which has substantially the same shape at that of the first embodiment, is formed on the front end portion 11*a* of the sheet guide 11 and the portion surrounded by this protruded portion 36 defines a substantially oval supporting shaft hole 37. The turnable supporting shaft 35 enters the inside of the turnable supporting shaft hole 37. A chamferred portion 36*a* is defined inside the protruded wall 36. The sheet guide 11 is positioned horizontally, as illustrated in solid line of FIG. 12.

When printing is performed on a cut sheet, the sheet guide 11 is turned counterclockwise about the turnable supporting shaft 35 and stopped after it is turned by the angle of about 60°. From this position, the sheet guide 11 is slid in the direction of the arrow B. At this time, the chamferred portion 36*a* is pressed against the chamferred portion 35*b* of the turnable supporting shaft 35 as illustrated in a chain line, whereby the sheet guide 11 is held while it remains standing. At this time, the sheet guide 11 is standing on the bracket 14 at the angle of 60° relative to the bracket 14.

When printing is performed on a continuous forms sheet, the front end portion 11*a* of the sheet guide 11 should come off from the bracket 14. This is easily accomplished, namely, the turnable supporting shaft 35 easily comes off from the turnable supporting shaft hole 37 by raising the front end portion 11*a* of the sheet guide 11.

According to the second embodiment, the stopper 19 and the movable supporting shaft 12, which are provided in the first embodiment, can be omitted whereby the number of components is further reduced.

What is claimed is:

1. A sheet guide attaching mechanism of a printer comprising:

a first retaining portion formed on an upper portion of the printer;

a second retaining portion which is formed on the front end portion of a sheet guide and turnable and detachable relative to the first retaining portion;

a holding portion for holding the sheet guide while the latter remains standing;

a turnable supporting shaft which is formed on a rear end portion of the printer;

a third retaining portion which is formed on the rear end portion of the sheet guide turnable and detachable relative to the turnable supporting shaft; and wherein printing is performed on a cut sheet in the steps of allowing the third retaining portion to come off from the turnable supporting shaft, holding the sheet guide by the holding portion while the sheet guide remains standing, setting the cut sheet on the sheet guide so as to convey the cut sheet to a printing position and actuating a print head of the printer so as to perform printing on the cut sheet, and wherein printing is performed on a continuous forms sheet in the steps of allowing the first retaining portion to come off from the second retaining portion, turning the sheet guide about the turnable supporting shaft so as to make the sheet guide stand, setting the continuous forms sheet on the printer so as to convey the continuous forms paper to a printing position and actuating the print head so as to perform printing on the continuous forms sheet.

2. A mechanism according to claim 1, wherein said holding portion is a first holding portion, further including a second holding portion, provided at the rear end portion of the sheet guide, for holding said sheet guide while said sheet guide remains standing, after said sheet guide is turned about said turnable supporting shaft.

3. A mechanism according to claim 1, wherein said holding portion comprises a movable supporting shaft provided at the front end portion of the sheet guide, a movable supporting shaft receiver for receiving the shaft and a stopper provided on said printer for preventing the front end portion of the sheet guide from being turned.

4. A mechanism according to claim 1, wherein said first retaining portion comprises an oval shaft hole and said second retaining portion comprises a shaft.

5. A mechanism according to claim 4, wherein said holding portion comprises chamferred portions defined on the shaft, a chamferred portion defined on said shaft hole and a protruded wall for forming said shaft hole.

6. A mechanism according to claim 1, wherein said turnable supporting shaft has chamferred portions and wherein said third retaining portion is bent to come off from said turnable supporting shaft along the chamferred portions when the rear end portion of said sheet guide is detached from said printer and retained on the chamferred portions of said turnable supporting shaft when the front end portion of said sheet guide is detached from said printer.

7. A printer, comprising a printer body having a body upper portion and a body rear portion;

a sheet guide having a guide front end pivotally and detachably connected to said body upper portion, and a guide rear end pivotally and detachably connected to said body rear portion, so that said guide is pivotable on said body rear portion when said guide front end is detached from said body upper portion, and so that said guide is pivotable on said body upper portion when said guide rear end is detached from said body rear portion; and means for holding said guide in a standing position when said guide rear end is detached from said body rear portion.

8. A printer according to claim 7, wherein said means for holding is a first holding means and said standing position is a first standing position, further comprising a second holding means for holding said guide in a second standing position when said guide front end is detached from said body upper portion.

9. A printer according to claim 7, wherein said body upper portion is formed with a first retainer, said body rear portion being formed with a supporting shaft;

said guide front end being formed with a second retainer, said second retainer rotatably engaging said first retainer so as to pivotally connect said guide to said body upper portion, said second retainer being detachable from said first retainer;

said guide rear end being formed with a third retainer, said third retainer rotatably engaging said shaft so as to pivotally connect said guide to said body rear portion, so that said guide is pivotable on said body rear portion when said second retainer is detached from said first retainer, said third retainer being detachable from said shaft so that said guide is pivotable on said body upper portion when said third retainer is detached from said shaft and pivoted.

10. A printer according to claim 7, wherein the standing position is a first standing position, said guide being pivotable into a second standing position when said guide front end is detached from said body upper portion, said body including a print head, a platen opposing said print head, said guiding guide cut sheets toward said platen when said guide is in the first standing position, and means for conveying a continuous forms sheet to a location between said platen and said print head and along a path from said location successively across said upper portion to said body rear portion, when said guide is in the second standing position.

11. A printer according to claim 7, wherein said means for holding comprises a supporting shaft on said guide front end, a supporting shaft receiver on said body upper portion for receiving said shaft, and a stopper on said body upper portion for limiting pivotal movement of said guide front end with respect to said body upper portion.

12. A printer according to claim 7, wherein said body upper portion is formed with a first retainer, said first retainer having an oval hold formed therein, said guide front end being formed with a second retainer, said second retainer including a shaft rotatably and detachably engaged in said oval hole.

13. A printer according to claim 12, wherein said first retainer includes a protruding wall on said body portion, said oval hole formed in said protruding wall, said means for holding comprising chamfered portions of said shaft and a chamfered portion of said protruding wall, said chamfered portion of said protruding wall bounding said oval hole.

14. A printer according to claim 7, wherein said guide rear end is formed with a bendable retainer, said body rear portion being formed with a supporting shaft having chamfered portions; said retainer rotatably engaging said shaft so as to pivotally connect said guide to said body rear portion, such that said guide is pivotable on said body rear portion when said guide front end is detached from body upper portion, said retainer being engagable with said chamfered portions for bending said retainer to detach said retainer from said shaft, so that said guide is pivotable on said body upper portion when said retainer is detached from said shaft and pivoted.

15. A printer, comprising a printer body having an body upper portion and a body rear portion, said printer body including a print head, and a platen opposing said print head;

a first retainer formed on said body upper portion;

a supporting shaft connected to said body rear portion;

a sheet guide having a guide front end and a guide rear end;

a second retainer formed on said guide front end, said second retainer rotatably engaging said first retainer so as to pivotally connect said guide to said body upper portion, said second retainer being detachable from said first retainer;

a third retainer formed on said guide rear end, said third retainer rotatably engaging said shaft so as to pivotally connect said guide to said body rear portion, so that said guide is pivotable on said body rear portion into a first standing position, when said second retainer is detached from said first retainer, said third retainer being detachable from said shaft, so that said guide is pivotable on said body upper portion into a second standing position, when said third retainer is detached from said shaft;

a first holding means for holding said guide in the first standing position, said guide when held in the first standing position guiding cut sheets toward said platen; and means for a conveying continuous form sheets to a location between said platen and said print head and along a path from said location successively across said body upper portion to said body rear portion, when said guide is in the second standing position.

16. A printer according to claim 15, further comprising a second holding means for holding said guide in the second standing position.

17. A method of using a printer alternatively to print on individual cut sheets and to print on a continuous forms sheet, the printer including (i) a printer body having a body upper portion, a body rear portion and a print head beneath the body upper portion, (ii) a sheet guide having a guide front end pivotally and detachably connected to the body upper portion, and a guide rear end, pivotally and detachably connected to the body rear portion, so that the guide is pivotable on the body rear portion when the guide front end is detached from the body upper portion, and so that the guide is pivotable on the body upper portion when the guide rear end is detached from the body rear portion, and (iii) means for holding the guide in a first standing position when the guide rear end is detached from the body rear portion, the method comprising the steps of:

pivoting the guide from the first standing position to a prone position on the body; such that the guide rear end rests on the body rear portion;

pivotally connecting the guide rear end to the body rear portion;

detaching the guide front end from the body upper portion;

pivoting the guide on the guide rear end to a second standing position in which guide rear end is standing on the body rear portion;

performing a first printer operation on the continuous forms sheet, including conveying the continuous forms sheet within the body to a printing position beneath the body upper portion, and actuating the printer head to perform printing on the continuous forms sheet, while conveying the printed continuous forms sheet from the printing position to the body upper portion and across the body upper portion toward the body rear portion; and performing a second printer operation on cut sheets, after the first printer operation, including pivoting the guide from the second standing position to the prone position, such that the guide front end rests on the body upper portion, pivotally connecting the guide front end to the body upper portion, detaching the guide rear end from the body rear portion, pivoting the guide on the guide front end to the first standing position, holding the guide in the first standing position with the holding means, setting a cut paper sheet on the guide, conveying the cut sheet to the printing position, and actuating the print head to perform printing on the cut sheet.

* * * * *